US008232932B2

(12) United States Patent
Takahashi et al.

(10) Patent No.: US 8,232,932 B2
(45) Date of Patent: Jul. 31, 2012

(54) DISPLAY DEVICE

(75) Inventors: Rintarou Takahashi, Saitama (JP); Takashi Akiyama, Saitama (JP)

(73) Assignee: Citizen Holdings Co., Ltd., Tokyo (JP)

( * ) Notice: Subject to any disclaimer, the term of this patent is extended or adjusted under 35 U.S.C. 154(b) by 1342 days.

(21) Appl. No.: 11/905,156

(22) Filed: Sep. 27, 2007

(65) Prior Publication Data

US 2008/0084379 A1 Apr. 10, 2008

(30) Foreign Application Priority Data

Sep. 29, 2006 (JP) ..... 2006-269299

(51) Int. Cl.
*G09G 3/30* (2006.01)

(52) U.S. Cl. ..... 345/76; 345/77; 345/78; 345/79; 345/204; 345/690; 315/169.1; 315/169.3

(58) Field of Classification Search ..... 345/76–100, 345/204, 690–693; 315/169.1–169.4
See application file for complete search history.

(56) References Cited

U.S. PATENT DOCUMENTS

| | | | | |
|---|---|---|---|---|
| 6,118,421 | A * | 9/2000 | Kawaguchi et al. | 345/89 |
| 2002/0175889 | A1* | 11/2002 | Tokonami et al. | 345/100 |
| 2005/0212745 | A1* | 9/2005 | Ishiyama | 345/96 |
| 2005/0253829 | A1* | 11/2005 | Mamba et al. | 345/204 |
| 2007/0040772 | A1* | 2/2007 | Kim | 345/76 |
| 2008/0246721 | A1* | 10/2008 | Kumada et al. | 345/96 |

FOREIGN PATENT DOCUMENTS

| | | | |
|---|---|---|---|
| JP | 07-248483 | A | 9/1995 |
| JP | 2003-330425 | A | 11/2003 |

OTHER PUBLICATIONS

Japanese Office Action dated Sep. 9, 2008, issued in corresponding Japanese Patent Application 2006-269299.

* cited by examiner

*Primary Examiner* — Quan-Zhen Wang
*Assistant Examiner* — Jennifer Nguyen
(74) *Attorney, Agent, or Firm* — Westerman, Hattori, Daniels & Adrian, LLP

(57) ABSTRACT

The present invention suppresses the generation of a leak current that accompanies the polarity inversion of the voltage waveform of the opposing electrode. The display device that performs display by sequentially scanning a plurality of scan signal lines in a single cycle period comprises: a plurality of data signal lines that intersect the scan signal lines; a pixel electrode that is connected to the data signal lines; and an opposing electrode that is disposed opposite the pixel electrode and for which the polarity of an application voltage is inverted in each of the cycle periods. The cycle period includes a scan period in which one full scan of the scan signal lines is performed and a non-scan period in which the scan signal lines are not scanned. In the non-scan period, the absolute value across the gate and drain is held at or above a predetermined value and the decrease in a voltage difference between a pixel potential and a gate OFF potential caused by the polarity inversion of the application voltage to the opposing electrode is reduced. In a non-scan period, the polarity of the voltage applied to the opposing electrode is fixed at either polarity irrespective of the polarity inversion of the voltage of the opposing electrode in each cycle period.

5 Claims, 16 Drawing Sheets

OPPOSING ELECTRODE POTENTIAL
Low
High
High
High
Low
High

GATE SIGNAL
SCAN PERIOD
NON-SCAN PERIOD
SCAN PERIOD
NON-SCAN PERIOD
SCAN PERIOD
NON-SCAN PERIOD
SUBFRAME
SUBFRAME
SUBFRAME

OPPOSING ELECTRODE POTENTIAL
Low
High
Low
Low
Low
Low

GATE SIGNAL
SCAN PERIOD
NON-SCAN PERIOD
SCAN PERIOD
NON-SCAN PERIOD
SCAN PERIOD
NON-SCAN PERIOD
SUBFRAME
SUBFRAME
SUBFRAME

OPPOSING ELECTRODE POTENTIAL
High
Low
High
Low

GATE SIGNAL
FIRST GATE OFF POTENTIAL
SECOND GATE OFF POTENTIAL
SCAN PERIOD
NON-SCAN PERIOD
SCAN PERIOD
NON-SCAN PERIOD
SCAN PERIOD
NON-SCAN PERIOD
SUBFRAME
SUBFRAME
SUBFRAME

OPPOSING ELECTRODE POTENTIAL WAVEFORM

GATE SIGNAL
FRAME
FRAME
FRAME

OPPOSING ELECTRODE POTENTIAL
High
Low
High
Low

GATE SIGNAL
SCAN PERIOD
NON-SCAN PERIOD
SCAN PERIOD
NON-SCAN PERIOD
SCAN PERIOD
NON-SCAN PERIOD
SUBFRAME
SUBFRAME
SUBFRAME

DISPLAY DEVICE

BACKGROUND OF THE INVENTION

1. Field of the Invention

The present invention relates to a display device and, more particularly, to a display device provided with a display panel comprising thin-film transistors (TFT) as switching elements for display pixel selection.

2. Description of the Related Art

Liquid-crystal display devices and organic EL display devices, for example, are known as display devices that comprise display panels which comprise thin-film transistors (TFT) as switching elements for display pixel selection. When the display selection of each pixel is performed with TFT's in such display devices, the voltage polarity of the opposing electrode must be inverted line by line and in each frame in order to decrease the residual image phenomenon, for example. Also, in inverted driving, aside from the effect of decreasing the residual image phenomenon, with frame-inversion driving and horizontal-line inversion driving, and so forth, it is possible to achieve the result of being able to halve the voltage amplitude applied to the signal lines by inverting the polarity of the opposing electrode voltage that is applied to the opposing electrode in sync with the inversion timing.

FIG. 15 shows an example where the polarity of the voltage applied to the opposing electrode is inverted in a display device. The display device selects and drives each pixel that the display panel comprises by sequentially applying a gate signal to the pixels (FIG. 15B). Normally, when the polarity of the opposing electrode is inverted in every frame, the voltage waveform of the opposing electrode is a rectangular waveform that is in sync with a fixed frame frequency (FIG. 15A, for example). In this case, by inverting the polarity of the voltage that is applied to the opposing electrode in every frame, it is possible to reduce the drive voltage and simplify the drive circuit in addition to reducing the residual image phenomenon known as "burn-in".

The display devices driven by TFT's may be driven in a cycle period which includes two periods, one of which is a scan period in which display is performed by sequentially scanning selecting, and driving the TFT of each pixel according a gate signal, and another of which is a non-scan period in which the TFT's of each pixel are not driven.

FIG. 16 serves to illustrate serves to illustrate the inversion of the voltage waveform of the opposing electrode in cyclical driving that includes a scan period and a non-scan period. In FIG. 16, a single subframe of a field sequential color system (described subsequently) is constituted by a scan period and a non-scan period. Here, the terms 'frame', 'subframe', and 'field' are used with substantially the same meaning. FIG. 16A shows the opposing electrode potential, and FIG. 16B shows the gate signal.

Here, the voltage polarity of the opposing electrode during the scan period is inverted in every subframe.

Japanese Patent Application Laid-open No. 2003-330425 discloses a display device in which the polarity of the voltage of the opposing electrode is inverted in each field in the non-scan period.

In conventional display devices, there is a problem that, when the polarity of the voltage waveform of the opposing electrode is inverted, a leak current is generated and the electrical charge in the pixel will flow out to the source line.

In order to suppress the generation of the leak current, in, for example, the case of N-type TFT elements, it is necessary to raise the absolute value of the gate-drain voltage of the data retention interval (the gate OFF period) above a fixed value by reducing the amplitude of the voltage of either the opposing electrode or the source line. However, when the amplitude of the voltage of either the opposing electrode or the source line is reduced in this manner, the problem that sufficient contrast cannot be obtained arises.

A field sequential color (hereafter abbreviated as 'FSC') system, according to which color display is performed as a result of a plurality of different wavelengths of light being sequentially emitted in a predetermined cycle and according to which the liquid crystals are driven in sync with the light source emission timing, is known as a color liquid crystal display system. However, such an FSC system requires a rapid response for the liquid crystals and it is necessary to apply a high voltage for this purpose. Therefore, the problem that an adequate contrast cannot be obtained in cases where the amplitude of the voltage of either the opposing terminal or the source line is reduced in order to suppress the generation of a leak current as mentioned earlier is then more obvious.

SUMMARY OF THE INVENTION

Thus, an object of the present invention is to solve the above problems, and, in display devices that are driven by inverting the polarity of the voltage of the opposing electrode and applying the inverted voltage, to suppress the generation of the leak current that accompanies the polarity inversion of the voltage waveform of the opposing electrode.

Also, an object of the present invention is to suppress the generation of the leak current that accompanies the polarity inversion of the voltage waveform of the opposing electrode without reducing the contrast characteristic.

A leak current is generated during the polarity inversion of the voltage waveform of the opposing electrode due to the fact that the pixel voltage potential shifts and approaches the gate OFF potential as a result of the polarity inversion of the voltage waveform of the opposing electrode and the absolute value of the gate-drain voltage of the TFT element grows small.

On that basis, the present invention suppresses the generation of a leak current by ensuring that the absolute value of the gate-drain voltage of the TFT element does not grow small when the polarity of the voltage waveform of the opposing electrode is inverted.

FIG. 1 serves to illustrate the gate-drain voltage of the N-type TFT in the cycle period.

The pixel electrode potential (drain potential) 104 is decided by the source potential 102 of a period in which the gate signal is at the gate ON potential with the opposing electrode potential 103 taken as the base. The source potential 102 is determined by selecting the potential corresponding with the display data from a predetermined range.

Due to the fact that the potential difference between the pixel electrode potential 104 and the opposing electrode potential 103 is maintained in periods when the gate signal is at the gate OFF potential, when the opposing electrode potential 103 is inverted from the high level to the low level, the pixel electrode potential (drain potential) 104 also fluctuates in accordance with this inversion.

In FIG. 1, the gate-drain voltage Vgd is the potential difference between the gate signal 101 and the pixel potential (drain potential) 104. The source potential 102 is selected from a predetermined range and, therefore, the pixel potential (drain potential) 104 also possesses a certain range (the range between the pixel potential 104H indicated by the thick broken line and the pixel potential 104L indicated by the thick broken line in FIG. 1).

The leak current flows more readily when the pixel potential (drain potential) is a potential close to the gate OFF potential and, therefore, here, the pixel potential (drain potential) 104H that is indicated by the thick broken line is observed as the gate-drain voltage Vgd pertaining to the leak current, and the potential difference between this pixel potential (drain potential) 104H and the gate signal 101 should be considered.

Because the pixel potential (drain potential) 104 approaches the gate OFF potential as a result of the opposing electrode potential 103 inverting from the high level to the low level, the gate-drain voltage Vgd approaches zero. Because the gate-drain voltage Vgd approaches zero, the current between the drain and source terminals of the TFT flows readily and charge that has accumulated in the pixel electrode flows out to the source line via the TFT.

FIG. 2 shows the relationship between the gate-drain voltage Vgd and the common potential Vcom of the opposing electrode and FIG. 3 is a characteristic diagram showing the relationship between the gate-drain voltage Vgd and the source-drain current Isd. As mentioned earlier, in the gate OFF period, the gate-drain voltage Vgd when the opposing electrode potential (Vcom) 103 is at the low level is closer to zero than the gate-drain voltage Vgd when the opposing electrode potential (Vcom) 103 is at the high level. The relationship between the gate-drain voltage Vgd and leak current can be illustrated by FIG. 3. The circled numbers 1 to 6 in FIGS. 1 to 3 each represent the corresponding periods.

FIG. 3A shows a case where the opposing electrode potential (Vcom) 103 is at the high level. Here, in the gate ON period (the circled number 2 in FIG. 3A), the TFT is in the ON state and the current Isd flows between the drain and source terminals, whereby the pixel electrode is charged. In addition, the TFT is in the OFF state in the gate OFF periods (circled numbers 1 and 3 in FIG. 3A), meaning that the outflow to the source line of the load that has accumulated in the pixel electrode via the drain and source terminals is suppressed.

FIG. 3B, on the other hand, shows a case where the opposing electrode potential (Vcom) 103 is at the low level. Here, in the gate ON period (the circled number 5 in FIG. 3B), the TFT is in the ON state and the current Isd flows between the drain and source terminals as mentioned above, whereby the pixel electrode is charged. In addition, in the gate OFF period (the circled number 4 in FIG. 3B) following the polarity inversion of the opposing electrode potential 103, the TFT does not enter the OFF state due to the current characteristic and a leakage state where a slight current flows is assumed. Hence, the load that has accumulated in the pixel electrode flows out to the source line via the drain and source terminals.

Therefore, the present inventor discovered that, based on the aforementioned relationship between the gate-drain voltage Vgd and source-drain current Isd, the generation of a leak current can be suppressed by ensuring that the gate-drain voltage Vgd deviates from close to zero in the non-scan periods, and more precisely, by making sure that the gate-drain voltage Vgd increased in the negative direction in the case of an N-type TFT element.

The display device of the present invention is a display device that performs display by sequentially scanning a plurality of scan signal lines in a single cycle period, comprising: a plurality of data signal lines that intersect the scan signal lines; a pixel electrode that is connected to the data signal lines; and an opposing electrode that is disposed opposite the pixel electrode and for which the polarity of an application voltage is inverted in each of the cycle periods. Here, the cycle period includes a scan period in which one full scan of the scan signal lines is performed and a non-scan period in which the scan signal lines are not scanned.

With the display device of the present invention, in the non-scan period, the absolute value of the gate-drain voltage is held at or above a predetermined voltage. As a result, the proximity of the potential difference between the pixel electrode potential and the gate OFF potential caused by the polarity inversion of the application voltage to the opposing electrode is reduced.

Here, as an aspect that holds the absolute value of the gate-drain voltage at or above a predetermined voltage, the display device of the present invention has an aspect wherein, in the non-scan period, the polarity of the voltage applied to the opposing electrode is fixed at either polarity irrespective of the polarity inversion of the voltage of the opposing electrode for each cycle period of a scan period.

In this aspect, provisions are taken so that the gate-drain voltage does not approach the gate OFF potential in accordance with the change in the polarity of the application voltage of the opposing electrode when switching from a scan period to a non-scan period by fixing the polarity of the application voltage of the opposing electrode. More specifically, in the case of an N-type TFT element, the polarity of the voltage waveform of the opposing electrode is fixed at a polarity at which the gate-drain voltage Vgd increases in a negative direction. As a result, the generation of a leak current is suppressed in a non-scan period irrespective of the polarity inversion of the voltage waveform of the opposing electrode in the scan period.

In addition, in an aspect in which the polarity of the voltage applied to the opposing electrode is fixed at either polarity, a potential which is either a low level potential or a high level potential is, more precisely, applied to the opposing electrode in non-scan periods.

Here, in cases where the display device is a liquid-crystal display device comprising a liquid-crystal layer between a pixel electrode and an opposing electrode, a high level potential is applied to the opposing electrode in all the non-scan periods. In addition, in cases where the display device is an organic EL display device comprising an organic layer between the pixel electrode and the opposing electrode, a low level potential is applied to all of the non-opposing electrodes.

With the display device of the present invention, the absolute value of the gate-drain voltage can also be held at or above a predetermined voltage by means of another aspect. This other aspect is such that, by changing the voltage applied to the gate electrode in accordance with the inversion of the polarity of the voltage applied to the opposing electrode in the non-scan periods, the potential of the gate electrode is changed in response to the change in the potential of the pixel electrode that accompanies the change in the polarity of the application voltage of the opposing electrode when switching from a scan period to a non-scan period and, accordingly, the potential of the pixel electrode never approaches the gate OFF potential in the non-scan periods.

In an aspect in which the voltage applied to the gate electrode is changed, the display device of the present invention is a display device that performs display by sequentially scanning a plurality of scan signal lines in a single cycle period, comprising: a plurality of data signal lines that intersect the scan signal lines; a pixel electrode that is connected to the data signal lines; an opposing electrode that is disposed opposite the pixel electrode; and a TFT element that is connected to each pixel electrode, wherein the gate terminal of the TFT element is connected to the scan signal lines; the source terminal is connected to the data signal lines; and the drain terminal is connected to the pixel electrode.

Here, the single cycle period includes a scan period in which one full scan of the scan signal lines is performed and a non-scan period in which the scan signal lines are not scanned; and a potential that is alternately inverted between a low level potential and a high level potential is applied to the opposing electrode in the scan period and non-scan period in each of the single cycle periods. Here, in a non-scan period in which a high level potential is applied to the opposing electrode, a first gate OFF potential is applied to the gate terminal; and, in a non-scan period in which a low level potential is applied to the opposing electrode, a second gate OFF potential of a lower potential than the first gate OFF potential is applied to the gate terminal.

Thus, in a non-scan period, by switching the gate OFF potential from the first gate OFF potential to a second gate OFF potential of a lower voltage than the first gate OFF potential depending on whether the potential applied to the opposing electrode is at the high level or low level, the potential of the pixel electrode never approaches the gate OFF potential in the non-scan periods.

The single cycle period may also comprise a plurality of frames. In field-sequential liquid-crystal driving, a single cycle period can comprise three subframes and can have field periods or frame periods for displaying one image. Data signals that correspond to the subframes are sequentially applied to the plurality of data signal lines in the scan period of the cycle period.

According to the display device of the present invention, in the driving of the display device that applies the voltage of the opposing electrode after inverting the polarity, the generation of a leak current that accompanies the polarity inversion of the voltage waveform of the opposing electrode can be suppressed.

In addition, the generation of a leak current that accompanies the polarity inversion of the voltage waveform of the opposing electrode can be suppressed without reducing the contrast characteristic.

DESCRIPTION OF THE PREFERRED EMBODIMENTS

The liquid-crystal display device according to the present invention will be described hereinbelow in detail using the drawings.

Figure 1:
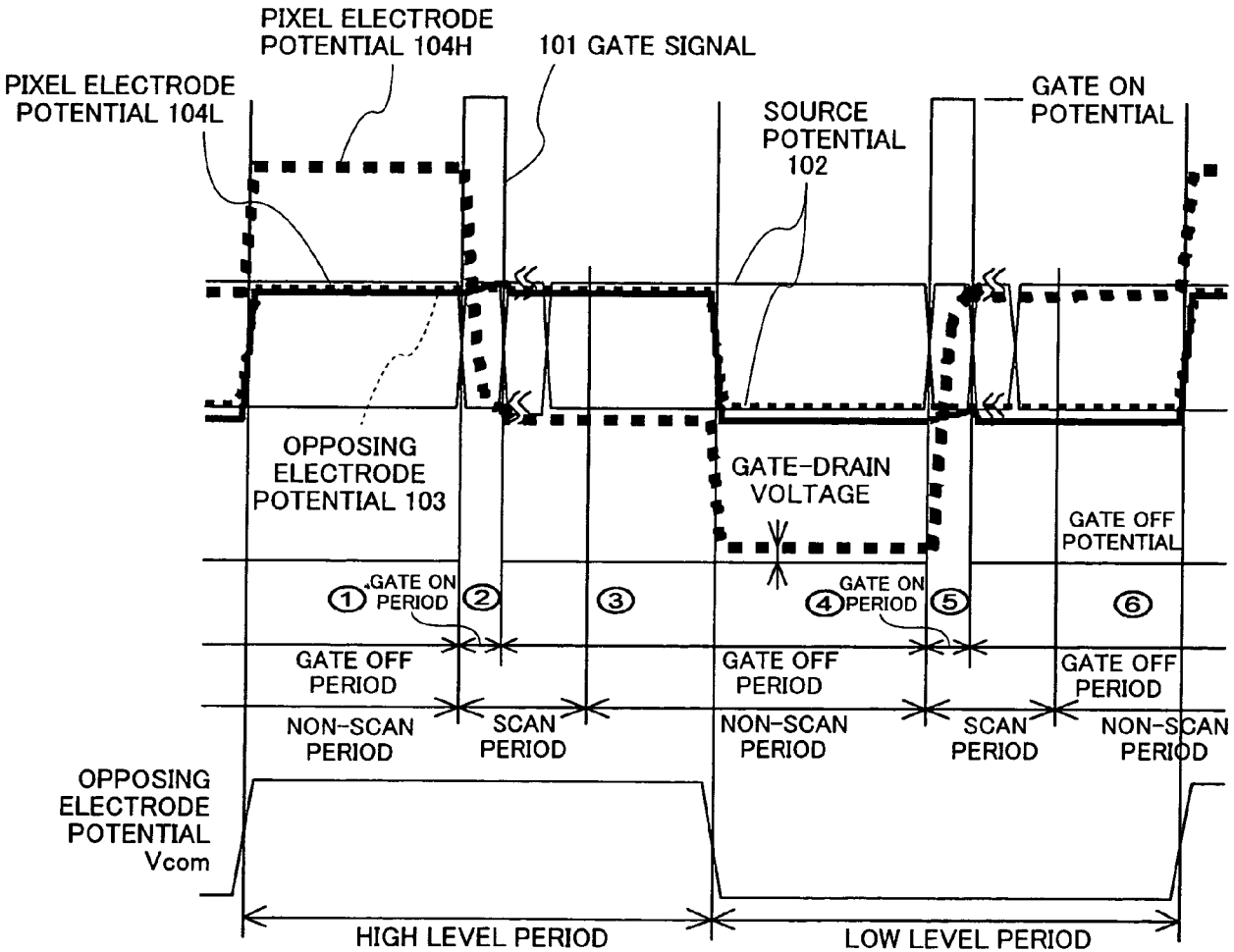
FIG. 1 serves to illustrate the gate-drain voltage in cycle periods.
Figure 2:
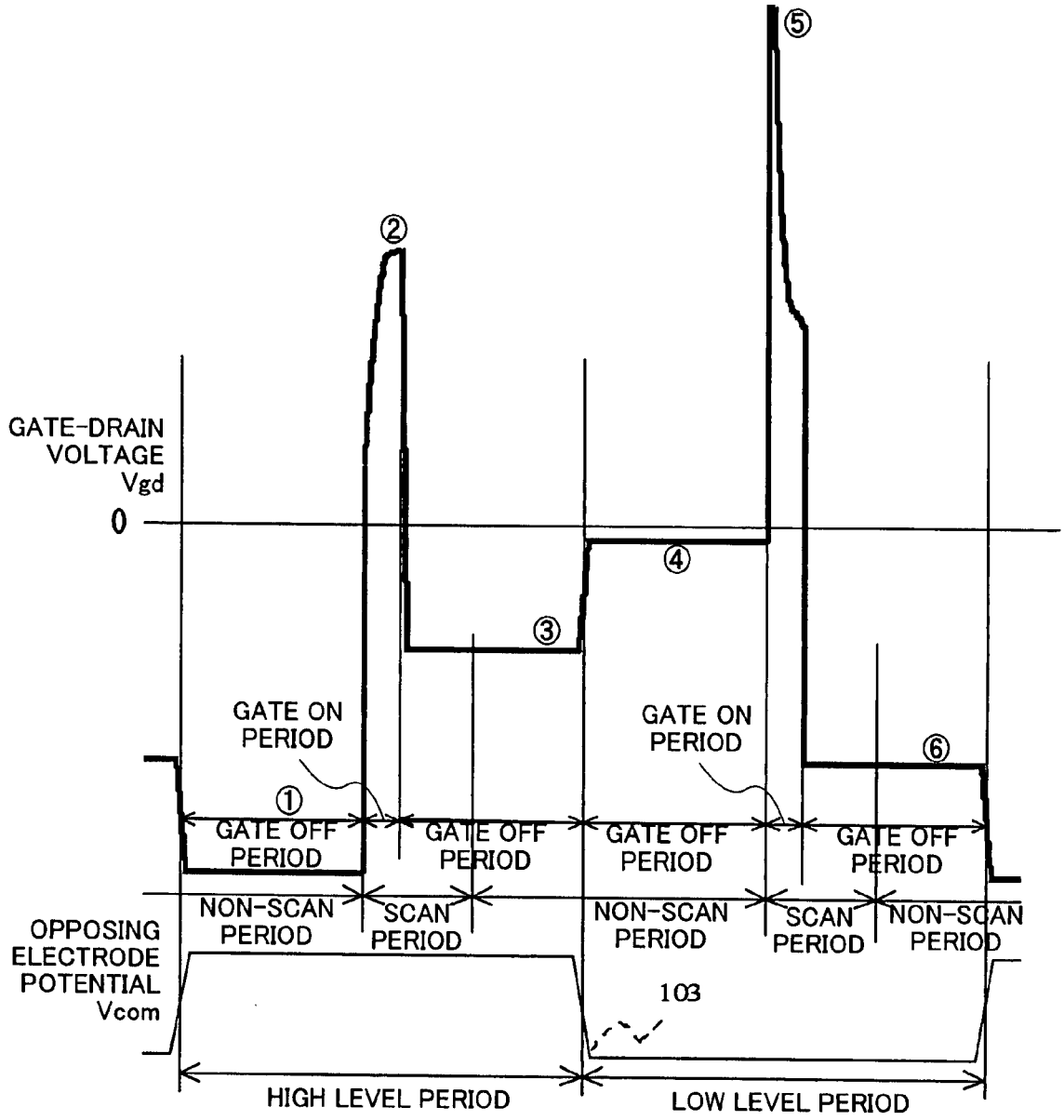
FIG. 2 shows the relationship between the gate-drain voltage Vgd and the common potential Vcom of the opposing electrode for a conventional display device.
Figure 3A:
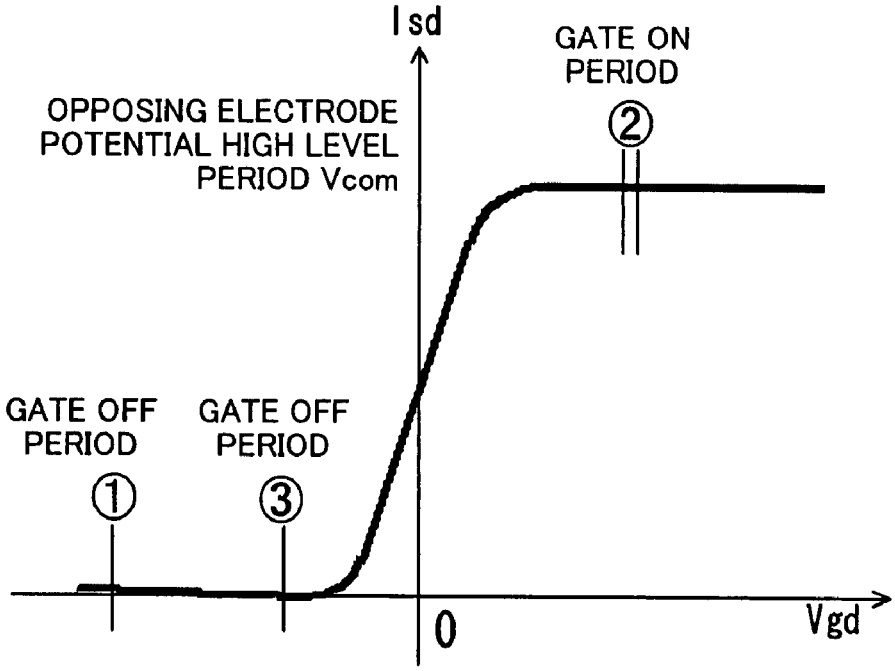
FIG. 3 is a characteristic diagram that illustrates the relationship between the gate-drain voltage Vgd and the source-drain current Isd of a conventional display device.
Figure 3B:
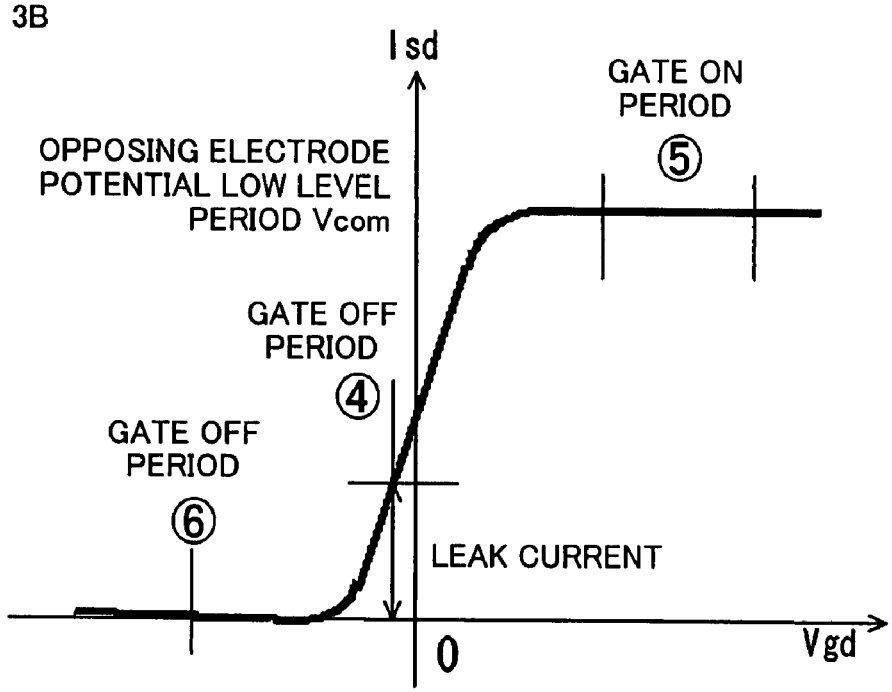
Figure 4:
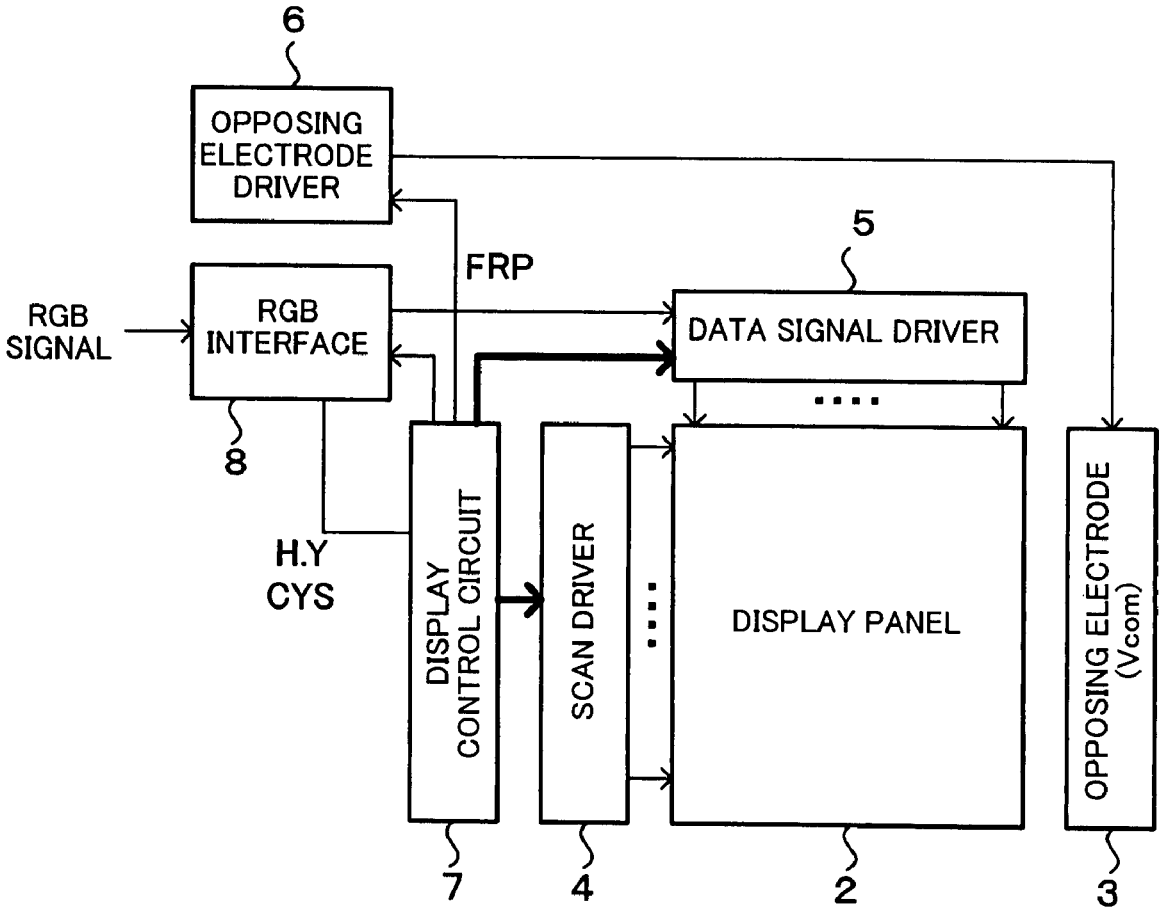
FIG. 4 is a schematic constitutional view that serves to illustrate a constitutional example of the display device of the present invention.

FIG. 4 is a schematic constitutional view that serves to illustrate a constitutional example of the display device of the present invention.

The display device 1 of the present invention comprises a display panel 2 that performs display, a scan signal driver 4 that supplies a scan signal to scan lines that the display panel 2 comprises, a data signal driver 5 that supplies a data signal to data signal lines that the display panel 2 comprises, an opposing electrode 3 that is disposed opposite the pixel electrodes that the display panel 2 comprises, and an opposing electrode driver 6 that drives the opposing electrode 3.

Here, an active-matrix-type liquid-crystal panel is described by way of example as the display panel 2 but an organic EL panel may also be used.

The display panel 2 comprises a plurality of scan signal lines that correspond to the horizontal scan lines of an image, a plurality of data signal lines (image signal lines) that intersect the scan signal lines, and a plurality of pixels (not shown in FIG. 4) that are provided in correspondence with the intersections between the scan signal lines and data signal lines. The pixels display an image upon receipt, via an image signal line, of an image signal from an external signal source.

An external signal source such as a CPU supplies an image signal, which comprises image data of an RGB signal or the like and display control data such as the display clock frequency that determines the timing of the display operation, and so forth, to a display control circuit 7 via an RGB interface 8. The display control circuit 7 generates a display clock signal, a horizontal synchronization signal, a vertical synchronization signal, a start pulse signal, and a latch strobe signal and so forth on the basis of the image signal thus supplied.

In addition, the display control circuit 7 subjects the image data to signal processing to generate image signals representing the grayscales of the respective colors red R, green G, and blue B and outputs the image signals to the data signal driver 5. The display control circuit 7 also outputs the clock signal, start pulse signal, latch strobe signal, and image signals to the data signal driver 5 and outputs the horizontal synchronization signal and vertical synchronization signal to a scan driver 4.

In addition to being supplied with image data that are displayed on the display panel 2 in pixel units, the data signal driver 5 is supplied with the clock signal, the start pulse signal, and the latch strobe signal as timing signals. The data signal driver 5 generates image signals for driving the display panel 2 on the basis of each of these signals and outputs the image signals to the respective image signal lines of the display panel 2.

The scan signal driver 4 generates a scan signal and outputs same to the respective scan signal lines on the basis of the horizontal synchronization signal and vertical synchronization signal. The scan signal sequentially selects the scan signal lines of the display panel 2 one horizontal scan period at a time. The application of an active scan signal for the ordered selection of all of the respective scan signal lines to each scan signal line is repeated by taking one vertical scan period as the cycle.

In addition, an FRP signal for inverting the polarity of the application voltage of the opposing electrode to the opposing electrode driver 6 is supplied by the display control circuit 7. The opposing electrode driver 6 controls the polarity inversion of the voltage applied to the opposing electrode on the basis of the FRP signal.

Further, the display control circuit 7 is able to display all the image data by repeating the driving using predetermined cycle periods, sequentially emit a plurality of light of different wavelengths in predetermined cycles, perform color display using field sequencing that drives liquid crystals in sync with the light emission timing of the light source, and the predetermined cycle periods can be a field period or frame period in which one image is displayed, for example.

Figure 5:
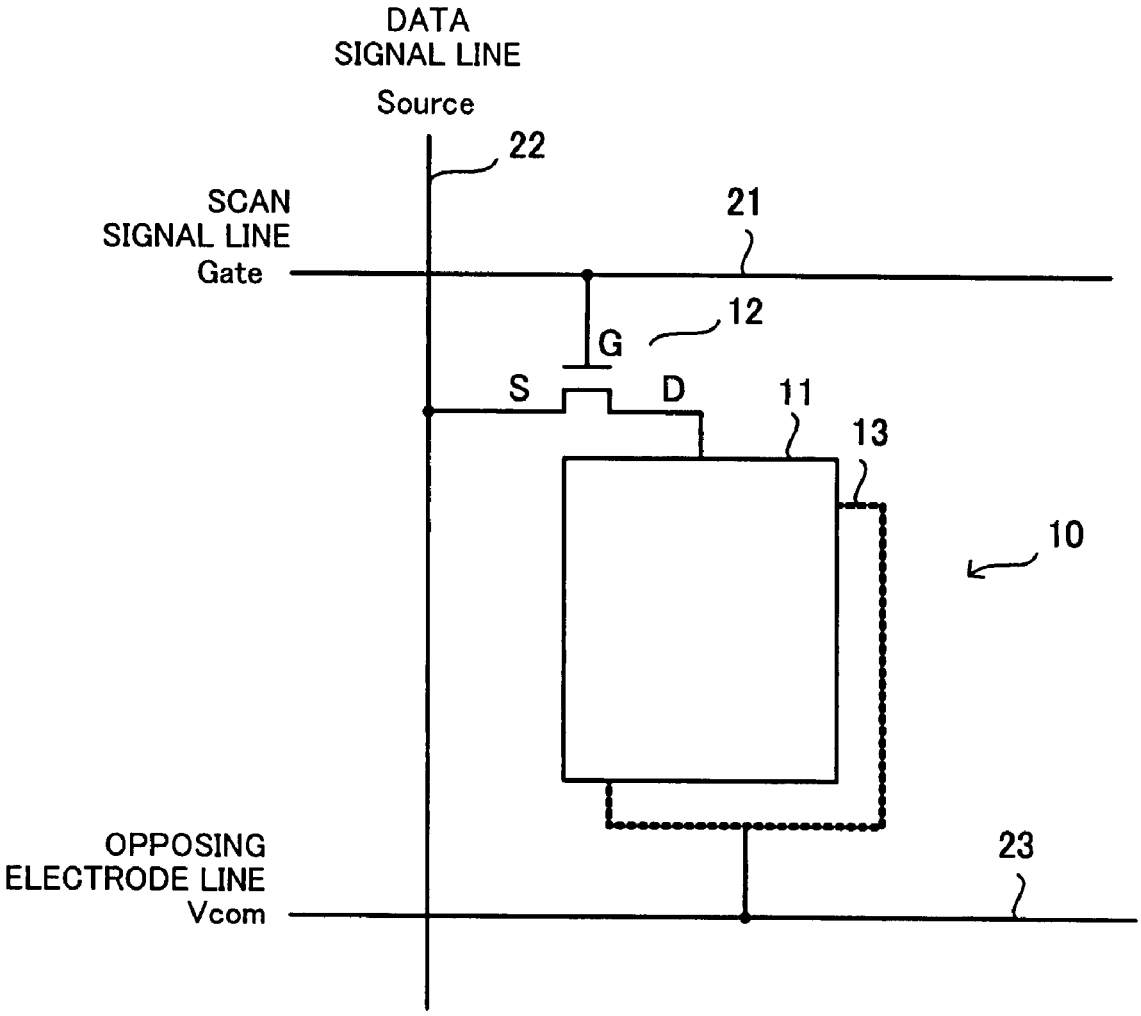
FIG. 5 is an equivalent circuit diagram for one pixel of a liquid crystal display panel which is the panel of the present invention that the display device of the present invention comprises.

FIG. 5 is an equivalent circuit for one pixel of a liquid crystal display panel also for the panel of the present invention that the display device of the present invention comprises. The display panel 2 comprises a plurality of data signal lines and a plurality of scan signal lines. The data signal lines are connected to the data signal driver 5 via a signal line selection circuit (not shown) and the scan signal lines are connected to the scan driver 4.

The plurality of data signal lines and plurality of scan signal lines are disposed in the form of a grating with the plurality of data signal lines and plurality of scan signal lines intersecting one another. A plurality of pixels 10 are provided in correspondence with the intersections therebetween. As shown in FIG. 5, the respective pixels 10 comprise a TFT transistor 12 the source terminal S of which is connected to a corresponding data signal line 22 that passes through an intersection, a pixel electrode 11 that is connected to the drain terminal D of the TFT transistor 12, a common electrode 13 that is provided so as to be common to a plurality of pixels 10, and a liquid crystal layer (not shown) that is interposed between the pixel electrode 11 and common electrode 13 and provided so as to be common to the plurality of pixels 10, wherein a pixel capacitance Cp is formed by the liquid crystal layer (not shown) that is interposed between the pixel electrode 11 and common electrode 13. In addition, the gate terminal G of the TFT transistor 12 is connected to a scan signal line 21. In the case of an organic EL panel, an organic layer is interposed between the pixel electrode 11 and the common electrode 13. Further, the opposing electrode 13 is connected to the opposing electrode line 23.

An aspect in which the absolute value of the voltage across the gate and drain of the display device of the present invention is equal to or more than a predetermined voltage will be described hereinbelow. This aspect is an aspect in which the polarity of the voltage applied to the opposing electrode is fixed at either polarity irrespective of the polarity inversion of the voltage of the opposing electrode in each cycle period of the scan period in a non-scan period.

Figures 6A, 6B:
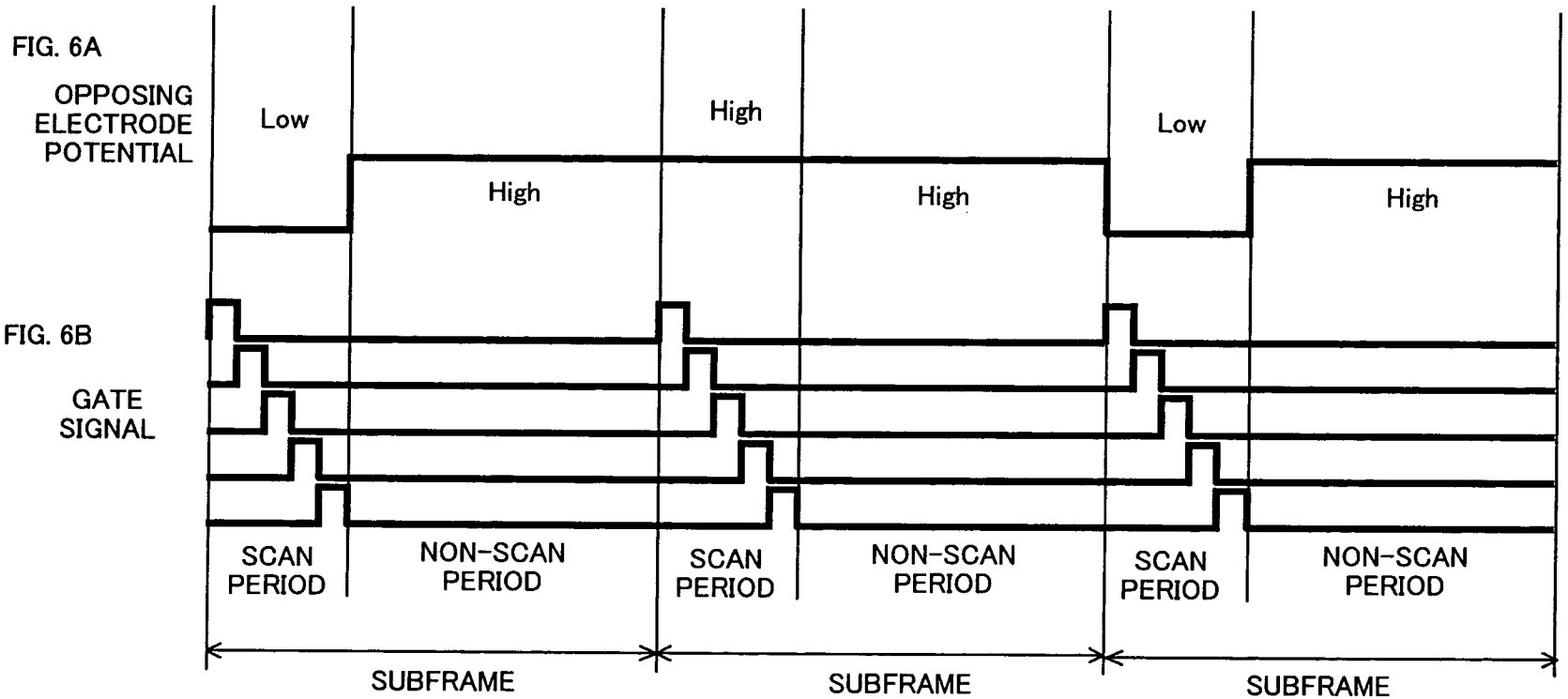
FIG. 6 represents an example that is applied to a liquid-crystal display device as the display device and is an aspect in which the polarity of the voltage applied to the opposing electrode of the present invention is fixed at the high level.

FIG. 6 is an aspect in which the polarity of the voltage applied to the opposing electrode is fixed at the high level and is an example that is applied to a liquid-crystal display device as the display device. FIG. 6A shows the opposing electrode potential and FIG. 6B shows a gate signal.

With the display device of the present invention, although, for the polarity inversion of the opposing electrode potential, the polarity is inverted for each subframe of a scan period, in a non-scan period, the polarity is not inverted for each subframe in a non-scan cycle; the polarity is always fixed at one polarity. In a liquid-crystal display device, the polarity of the voltage waveform of the opposing electrode is always fixed at the high level in a non-scan period.

Accordingly, the generation of a leak current is suppressed so that the gate-drain voltage Vgd is not close to zero.

Figures 7A, 7B:
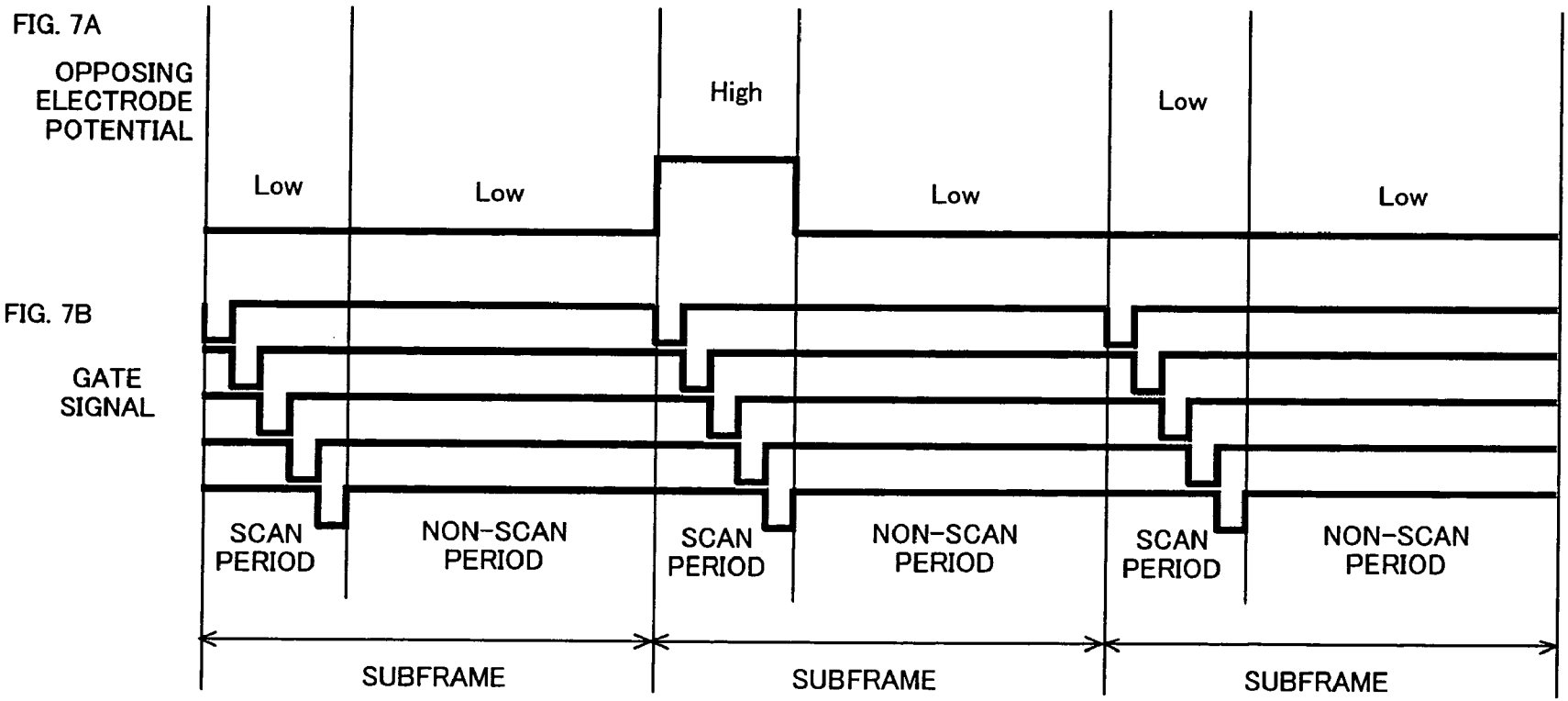
FIG. 7 represents an example that is applied to an organic EL display device as the display device and is an aspect in which the polarity of the voltage applied to the opposing electrode of the present invention is fixed at the low level.

In addition, FIG. 7 represents an example that is applied to an organic EL display device as the display device and is an aspect in which the polarity of the voltage applied to the opposing electrode of the present invention is fixed at the low level. FIG. 7A shows the opposing electrode potential and FIG. 7B shows the gate signal.

With the display device of the present invention, although the polarity is inverted for each subframe in the scan period in the polarity inversion of the opposing electrode potential, in the non-scan period, the opposing electrode potential is always fixed at the low level without inverting the polarity for each subframe. This is because, in liquid-crystal panels, the gate has an N-type characteristic that tends toward a positive bias whereas, in an organic EL panel, the gate has a P-type characteristic that tends toward a negative bias.

As a result, the generation of a leak current is suppressed so that the gate-drain voltage Vgd does not approach zero.

The case where the display device of the present invention is a liquid-crystal display device will be described in more detail hereinbelow by using the relationship diagrams that show the relationship between the gate-drain voltage Vgd and the common potential Vcom of the opposing electrode in FIGS. 8 and 9 and the characteristic diagram that shows the relationship between the gate-drain voltage Vgd and source-drain current Isd in FIG. 9.

Figure 8:
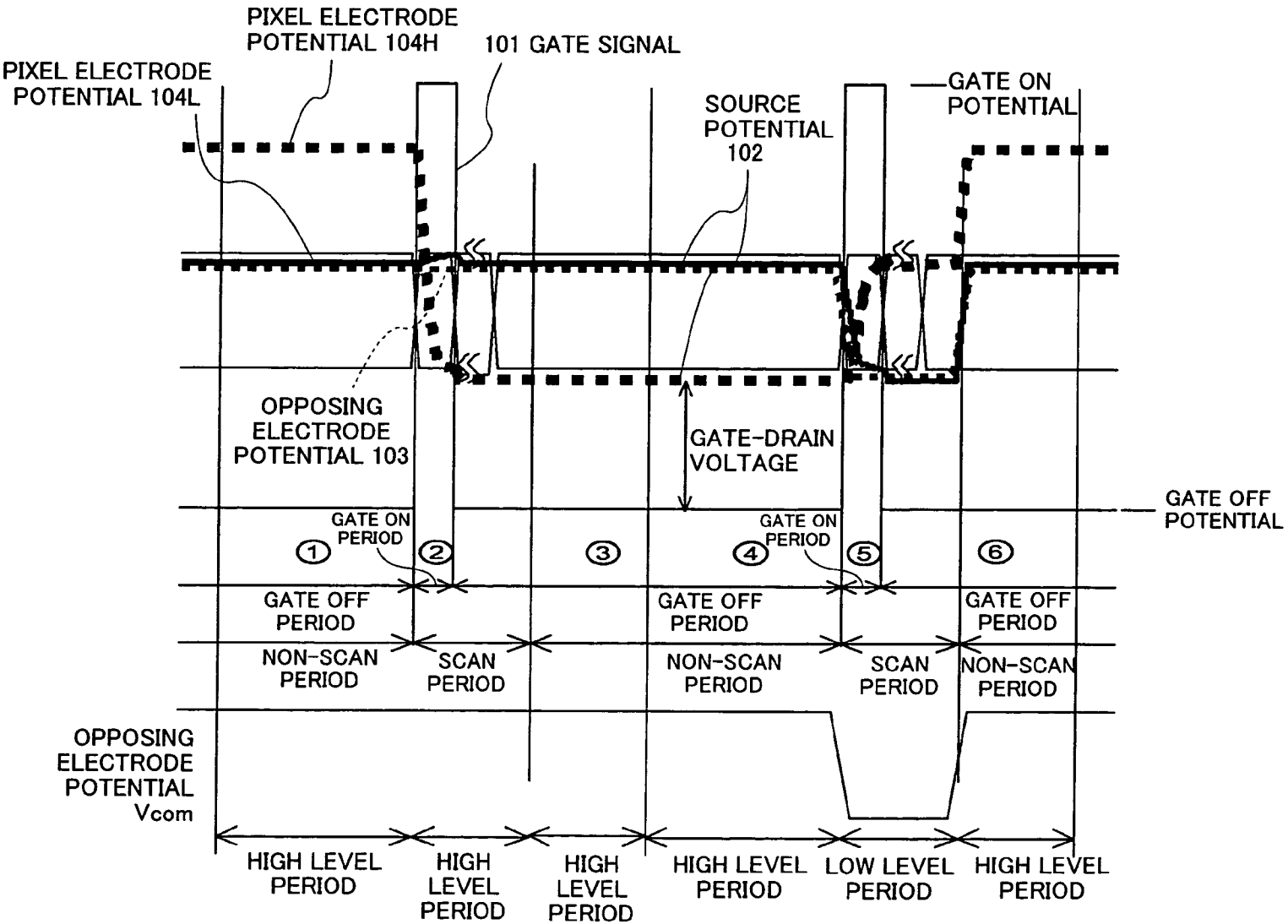
FIG. 8 shows the relationship between the gate-drain voltage Vgd and the common potential Vcom of the opposing electrode of the liquid-crystal display device of the present invention.
Figure 9:
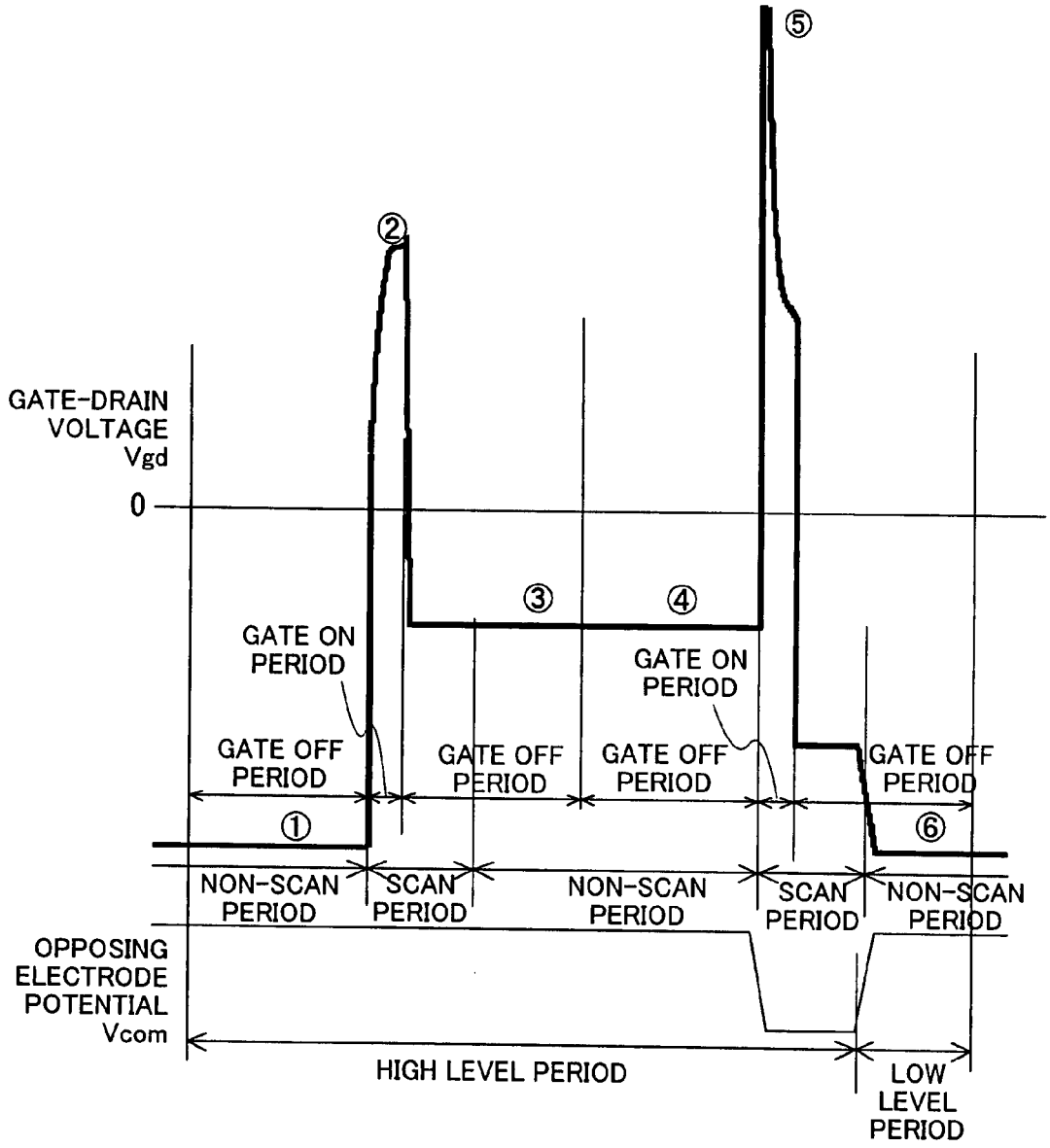
FIG. 9 shows the relationship between the gate-drain voltage Vgd and the common potential Vcom of the opposing electrode of the liquid-crystal display device of the present invention.

FIG. 8 shows a gate signal 101, source potential 102, opposing electrode potential (Vcom) 103, and pixel potential (drain potential) 104 and FIG. 9 shows the gate-drain voltage Vgd.

The gate signal 101 is a signal that is input to the gate terminal of the TFT. The TFT is set to the ON state by applying a gate ON potential in non-scan periods, during which time current flows from the source line to the pixel electrode and the capacitor between the pixel electrode and opposing electrode is charged. The application of the gate ON potential is carried out by sequentially scanning the respective pixel electrodes that the display panel comprises in scan periods. The gate signal shown in FIG. 8 represents the potential that is applied to one pixel electrode of the plurality of pixel electrodes that the display panel comprises.

The source potential 102 is determined by selecting the potential that corresponds with the display data from a predetermined range and is applied from the source lines to the pixel electrode as a result of the TFT being in the ON state in the scan periods.

The opposing electrode potential (Vcom) 103 is a potential for inverting the potential (drain potential) 104 of the pixel electrode charged by the source potential 102 in each cycle period. The display device of the present invention performs switching between the low level and high level alternately in the scan periods in each cycle period and is always fixed at the high level in the non-scan periods. Accordingly, the opposing electrode potential (Vcom) 103 is at the low level in at least every other scan period while inversion is carried out in the previous cycle period.

In the non-scan periods in FIGS. 8 and 9, the opposing electrode potential (Vcom) 103 is always set at the high level and there is no inversion to the low level. Since the pixel electrode potential (drain potential) is at a certain fixed potential difference higher than the gate OFF potential, the gate-drain voltage Vgd is sufficiently low and the leak current is reduced.

Figure 10:
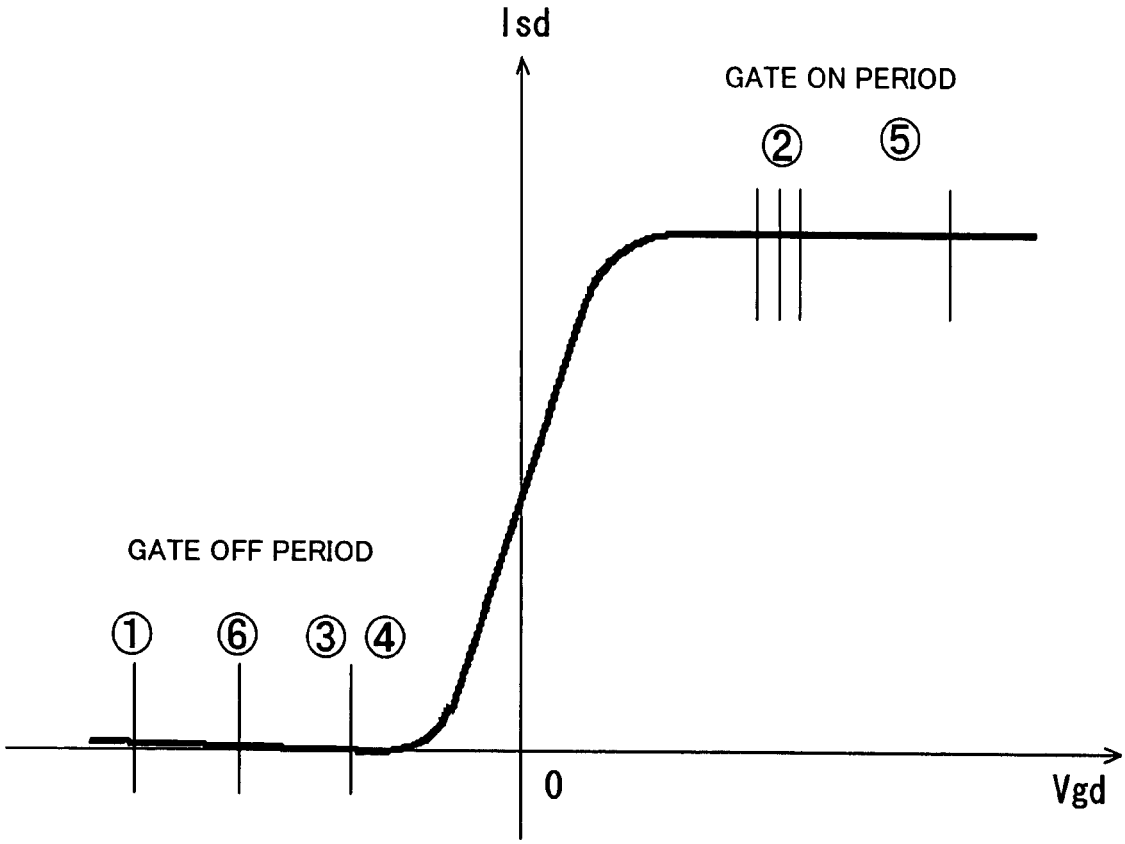
FIG. 10 is a characteristic diagram that illustrates the relationship between the gate-drain voltage Vgd and source-drain current Isd of the liquid-crystal display device of the present invention.

FIG. 10 is a characteristic diagram showing the relationship between the gate-drain voltage Vgd and the source-drain current Isd. The circled numbers 1 to 6 in FIGS. 8 to 10 represent each of the corresponding periods. FIG. 10 shows that, in the non-scan periods, a leak current is not generated even in periods in which the opposing electrode potential is at the low level (circled number 4, circled number 6).

The above description is also true for a case where there is an inversion characteristic as in the case of an organic EL display device, for example, which is illustrated with respect to an example where, for a liquid-crystal display device, the potential of the opposing electrode is fixed at the high level in the non-scan periods. Here, by fixing the potential of the opposing electrode at the low level in the non-scan periods, the gate-drain voltage Vgd is separated from zero and, accordingly, the leak current can be reduced. Here, an example where the potential of the opposing electrode is fixed at a low level is not described.

Another aspect in which the absolute value of the gate-drain voltage of the display device of the present invention is equal to or more than a predetermined voltage will be described next. This aspect is such that, by changing the voltage applied to the gate electrode in accordance with the inversion of the polarity of the voltage applied to the opposing electrode in the non-scan periods, the potential of the gate electrode is changed in response to the change in the potential of the pixel electrode that accompanies the change in the polarity of the application voltage of the opposing electrode when switching from a scan period to a non-scan period and, accordingly, the potential of the pixel electrode never approaches the gate OFF potential in the non-scan periods.

Therefore, this aspect can also be applied to an aspect where the polarity of the voltage applied to the opposing electrode is inverted as in the scan period without the polarity of the voltage applied to the opposing electrode being fixed at either polarity in the non-scan period as per the aforementioned aspect.

Figures 11A, 11B:
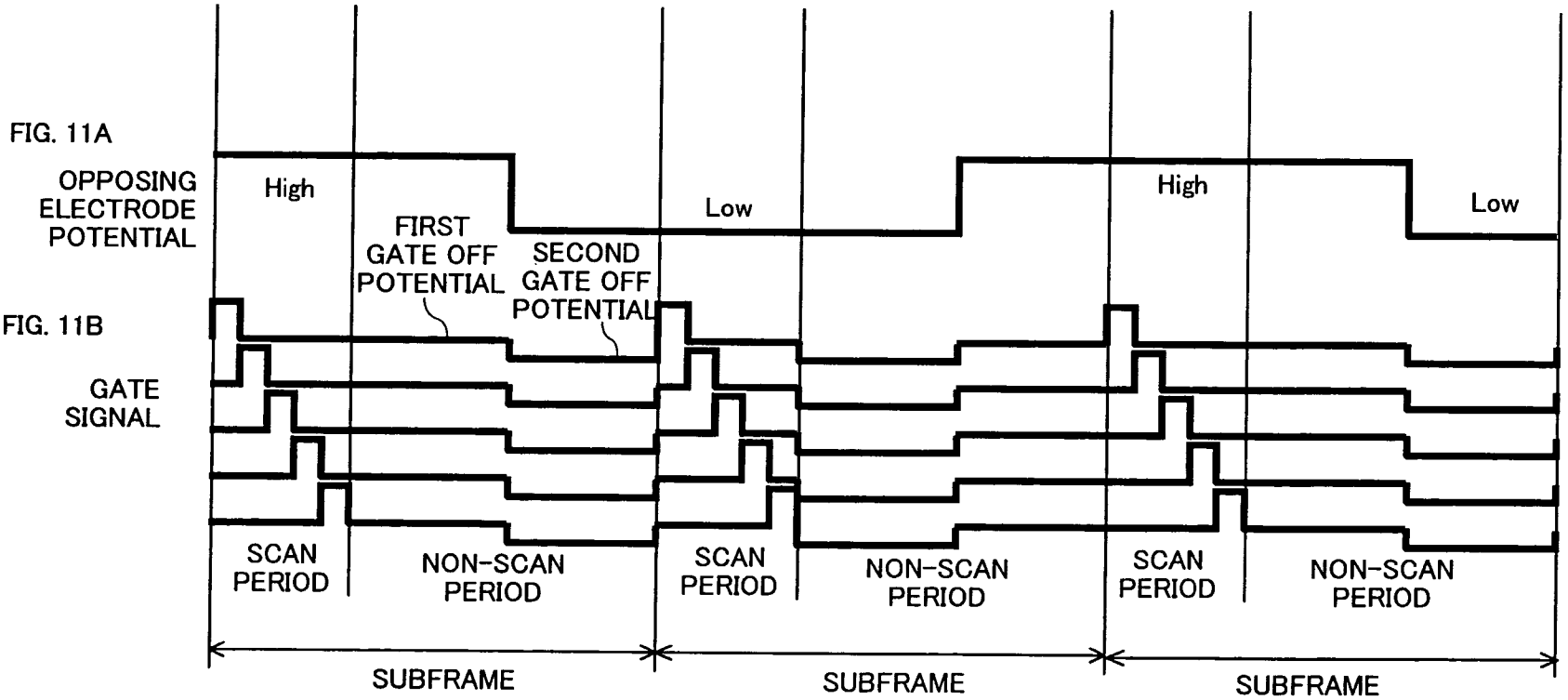
FIG. 11 shows an aspect in which the gate potential is changed.

FIG. 11 represents an aspect in which the voltage applied to the gate electrode is changed in accordance with the inversion of the polarity of the voltage applied to the opposing electrode and, accordingly, the potential of the gate electrode is changed in response to the change in the potential of the pixel electrode that accompanies the change in the polarity of the application voltage of the opposing electrode. FIG. 11A shows the opposing electrode potential and FIG. 11B shows the gate signal.

Here, the polarity of the voltage waveform of the opposing electrode is inverted in each subframe. In the display device of this aspect, the polarity of the potential of the opposing electrode is inverted for each subframe in the scan period and non-scan period that the cycle period contains. Here, in cases where the voltage of the opposing electrode is at the low level, the voltage applied to the gate electrode is changed (lowered here), whereby the generation of a leak current is suppressed so that the gate-drain voltage Vgd does not approach zero.

The case where the display device of the present invention is a liquid-crystal display device will be described in more detail hereinbelow by using the diagrams that show the relationship between the gate-drain voltage Vgd and the gate potential Vgate in FIGS. 12 and 13 and the characteristic diagram that shows the relationship between the gate-drain voltage Vgd and source-drain current Isd in FIG. 14.

Figure 12:
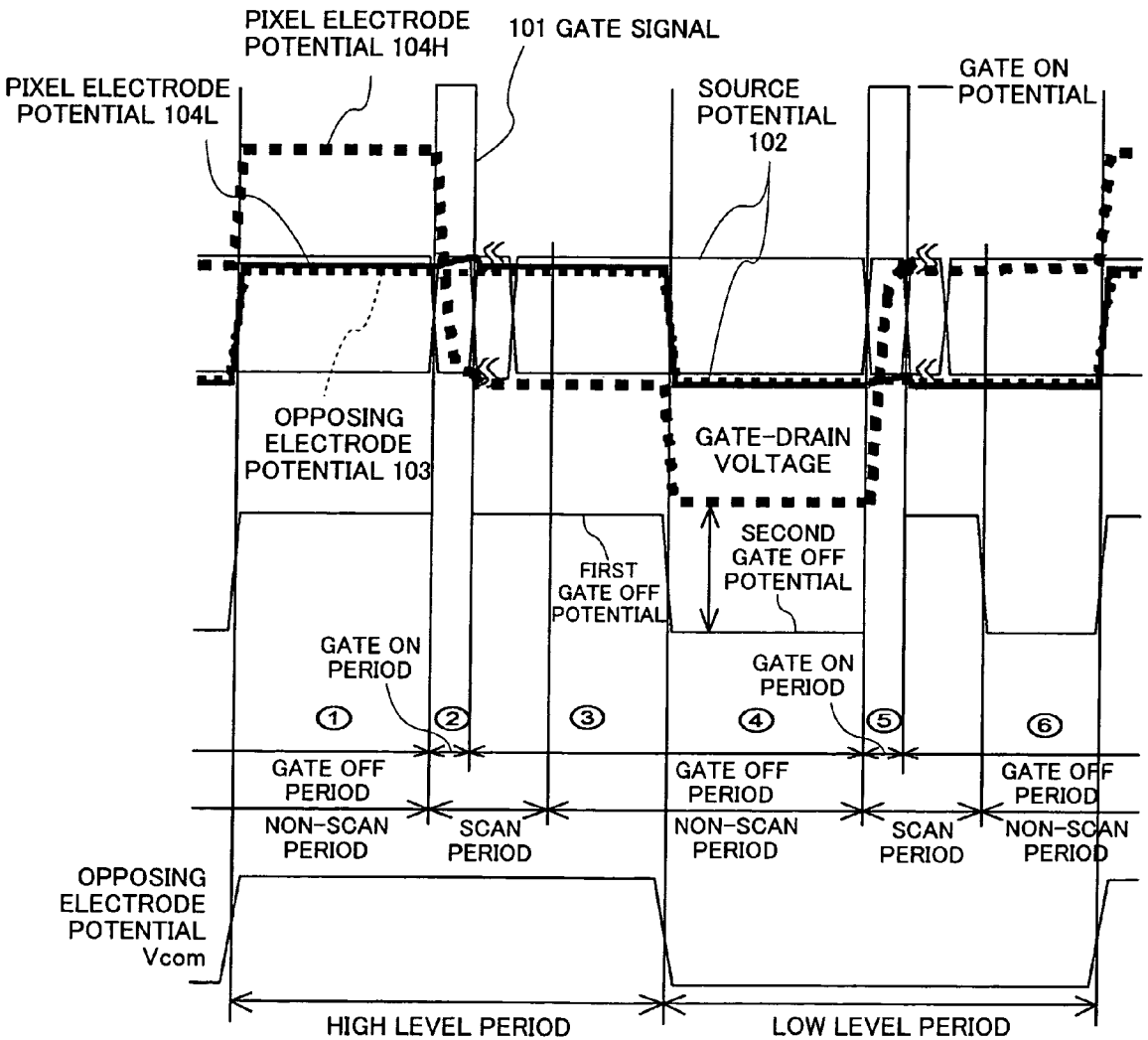
FIG. 12 shows the relationship between the gate-drain voltage Vgd and the gate potential Vgate.
Figure 13:
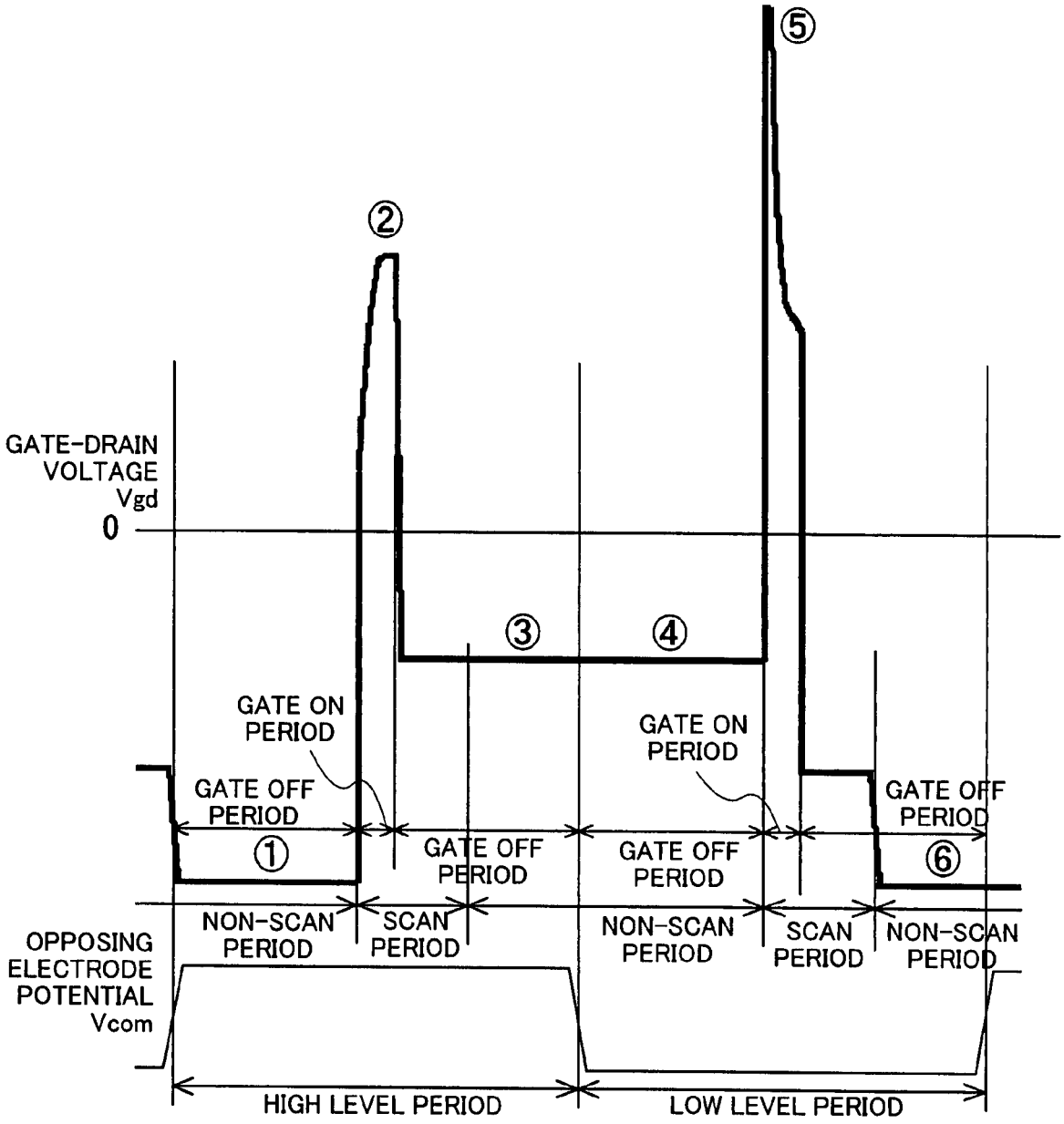
FIG. 13 shows the relationship between the gate-drain voltage Vgd and the gate potential Vgate.

FIGS. 12 and 13 show the respective potentials of the gate signal 101, source potential 102, opposing electrode potential (Vcom) 103, pixel potential (drain potential) 104, as well as the gate-drain voltage Vgd.

The source potential 102 is determined by selecting the potential that corresponds with the display data from a predetermined range and is applied from the source lines to the pixel electrode as a result of the TFT being in the ON state in the scan periods.

The opposing electrode common potential (Vcom) 103 is a potential for inverting the pixel potential (drain potential) 104 of the pixel electrode charged by the source potential 102 in each cycle period. The display device of the present invention performs switching between the low level and high level alternately in the scan periods and non-scan cycle periods. Inversion is accordingly carried out in each cycle period.

The gate signal 101 is a voltage that is input to the gate terminal of the TFT. The TFT is set to the ON state by applying a gate ON potential in scan periods, during which time current flows from the source line to the pixel electrode and the capacitor between the pixel electrode and opposing electrode is charged. The application of the gate ON potential is carried out by sequentially scanning the respective pixel electrodes that the display panel comprises in scan periods. The gate signal shown in FIG. 12 represents the potential that is applied to one pixel electrode of the plurality of pixel electrodes that the display panel comprises.

In addition, the gate signal 101 of this aspect changes to a lower potential than the high level potential when the opposing electrode potential (Vcom) 103 switches from the high level to the low level. Accordingly, the gate-drain voltage Vgd between the pixel potential (drain potential) 104 indicated by the broken line in FIG. 12 and the gate signal 101 widens, the gate-drain voltage Vgd moves away from zero, and the generation of a leak current is suppressed.

Figure 14:
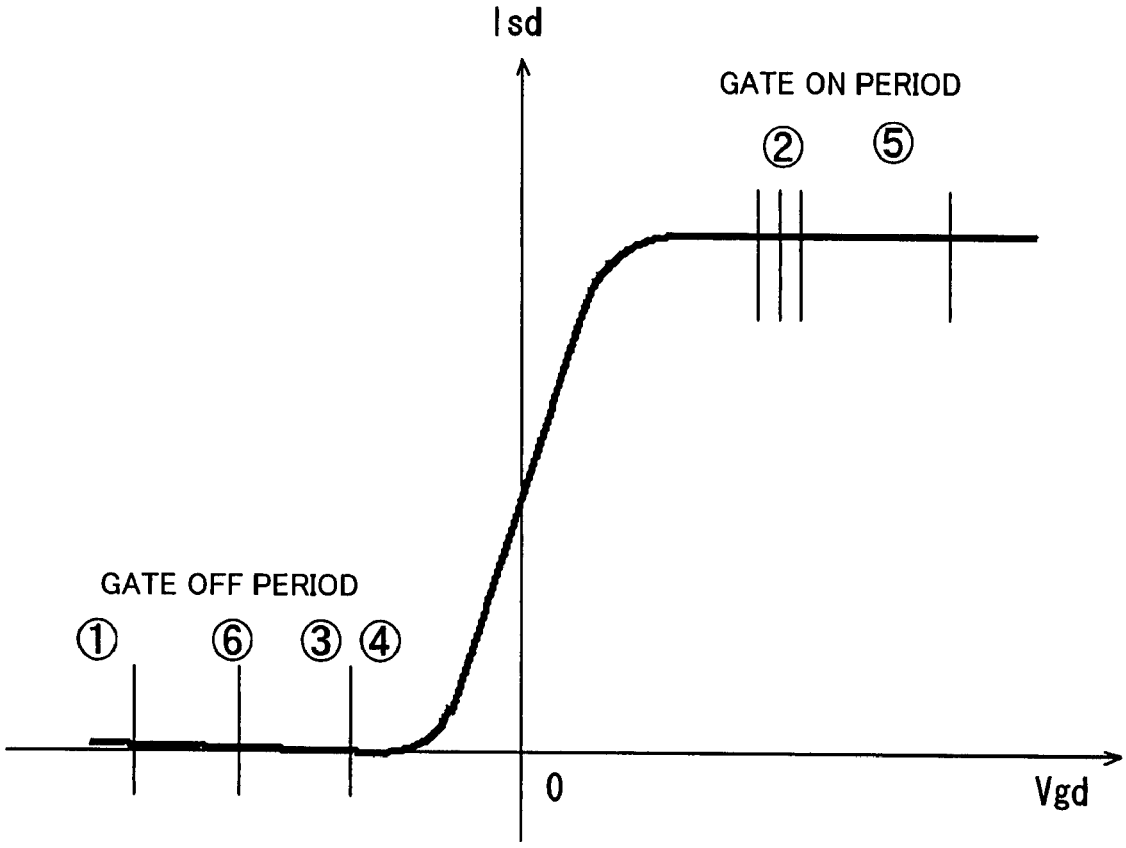
FIG. 14 is a characteristic diagram showing the relationship between the gate-drain voltage Vgd and the source-drain current Isd.
Figures 15A, 15B:
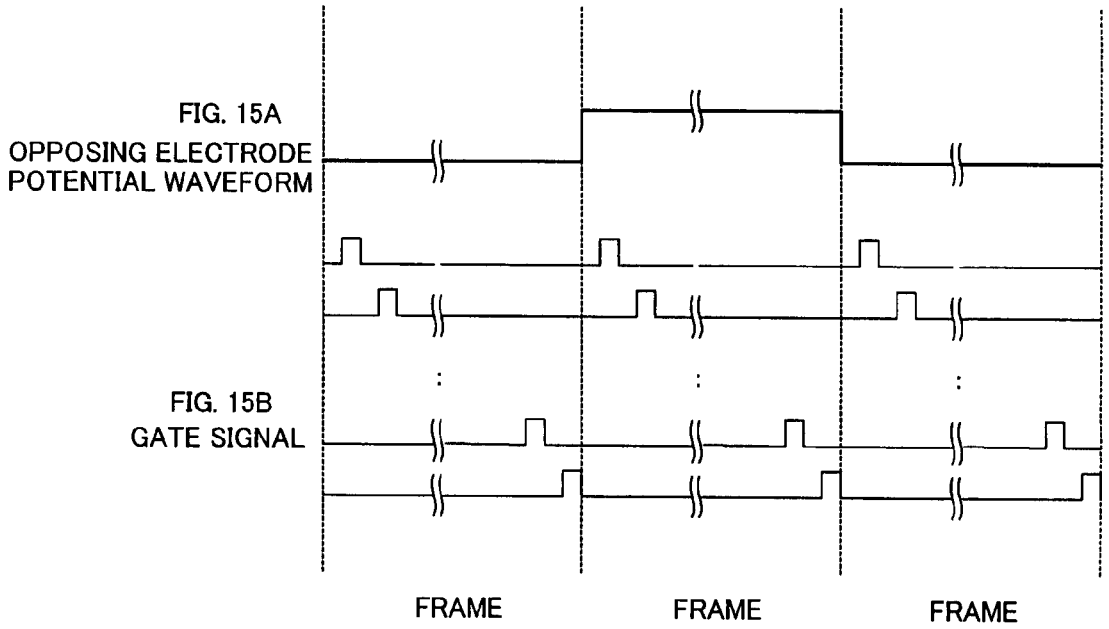
FIG. 15 represents an example in which the polarity of the voltage applied to the opposing electrode in the display device is inverted.
Figures 16A, 16B:
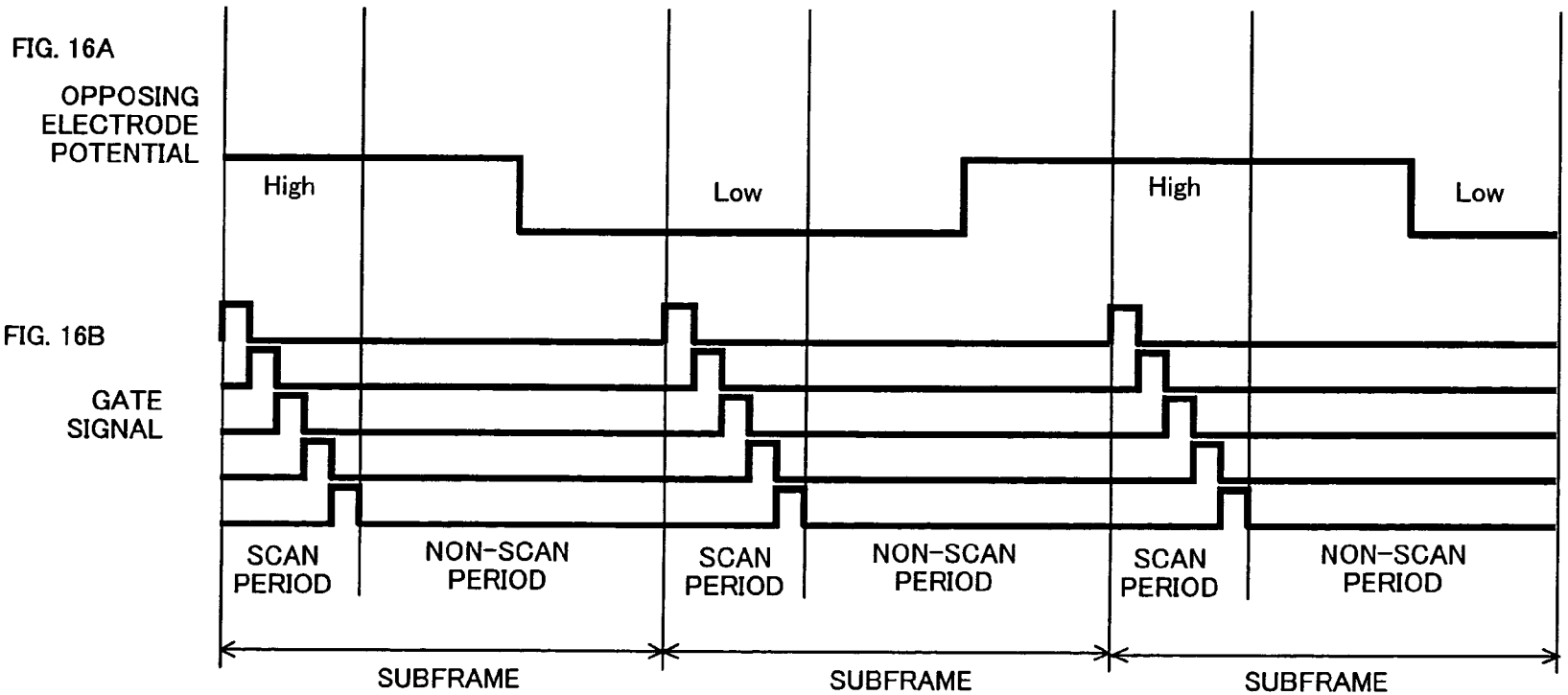
FIG. 16 serves to illustrate the inversion of the voltage waveform of the opposing electrode in cyclical driving that includes a scan cycle and a non-scan cycle.

FIG. 14 is a characteristic diagram that represents the relationship between the gate-drain voltage Vgd and the source-drain current Isd and shows that a leak current is not generated even in periods when the opposing electrode potential is at the low level in the non-scan period (the circled numbers 4 and 6). The circled numbers 1 to 6 in FIGS. 12 to 14 represent each of the corresponding periods.

According to the aspect of the present invention, because the generation of a leak current can be reduced so that the pixel potential does not approach the gate OFF potential without reducing the amplitude of the voltage applied to the source line or the voltage of the opposing electrode, a display of high contrast and a high-speed response is possible.

In addition, according to an aspect of the present invention, a display in which the potential of the opposing electrode undergoes polarity inversion can be maintained and, therefore, the polarity inversion effects afforded by a reduction in the residual image phenomenon, a reduction in the drive voltage, and simplification of the drive circuit can be continued.

Preferred embodiments of the liquid-crystal display device of the present invention were described hereinabove. However, the liquid-crystal display device according to the present invention are not limited to the above embodiments alone. Rather, it is understood that a variety of modified embodiments are possible within the scope of the present invention.

What is claimed is:

1. A display device that performs display by sequentially scanning a plurality of scan signal lines in a single cycle period, comprising:

a plurality of data signal lines that intersect the scan signal lines;

a pixel electrode that is connected to the data signal lines;

an opposing electrode that is disposed opposite the pixel electrode and for which the polarity of an application voltage is inverted in each of the cycle periods; and a TFT element that is connected to each pixel electrode, wherein the gate terminal of the TFT element is connected to the scan signal lines; the source terminal is connected to the data signal lines; and the drain terminal is connected to the pixel electrode;

the single cycle period includes a scan period in which one full scan of the scan signal lines is performed and a non-scan period in which the scan signal lines are not scanned; and in the non-scan period, an absolute value of voltage between the gate terminal and drain terminal of the TFT is held at or above a predetermined voltage and the decrease in a potential difference between a gate terminal potential during the non-scan period and a pixel electrode potential caused by the polarity inversion of the application voltage to the opposing electrode is reduced.

2. The display device according to claim 1, wherein, in the non-scan period, the polarity of the voltage applied to the opposing electrode is fixed at either polarity irrespective of the polarity inversion of the application voltage for each cycle period.

3. The display device according to claim 1, wherein the single cycle period is a field period or frame period in which one image is displayed in liquid-crystal driving using a field sequential, and data signals are sequentially applied to the plurality of data signal lines in the scan period within the cycle period.

4. A display device that performs display by sequentially scanning a plurality of scan signal lines in a single cycle period, comprising:

a plurality of data signal lines that intersect the scan signal lines;

a pixel electrode that is connected to the data signal lines;

an opposing electrode that is disposed opposite the pixel electrode; and a TFT element that is connected to each pixel electrode, wherein the gate terminal of the TFT element is connected to the scan signal lines; the source terminal is connected to the data signal lines; and the drain terminal is connected to the pixel electrode;

the single cycle period includes a scan period in which one full scan of the scan signal lines is performed and a non-scan period in which the scan signal lines are not scanned;

a potential that is alternately inverted between a low level potential and a high level potential is applied to the opposing electrode in the scan period and non-scan period in each of the single cycle periods;

in a non-scan period in which a high level potential is applied to the opposing electrode, a first gate OFF potential is applied to the gate terminal; and in a non-scan period in which a low level potential is applied to the opposing electrode, a second gate OFF potential of a lower potential than the first gate OFF potential is applied to the gate terminal.

5. The display device according to claim 4, wherein the single cycle period is a field period or frame period in which one image is displayed in liquid-crystal driving using a field sequential, and data signals are sequentially applied to the plurality of data signal lines in the scan period within the cycle period.

* * * * *